United States Patent [19]

Colamussi et al.

[11] 4,103,497

[45] Aug. 1, 1978

[54] MANOEUVRABLE WEIR

[75] Inventors: Arturo Colamussi; Vittorio Merli, both of Ferrara, Italy

[73] Assignee: Pirelli Furlanis - Applicazioni Idrauliche Agricole Gomma S.p.A., Milan, Italy

[21] Appl. No.: 786,552

[22] Filed: Apr. 11, 1977

[30] Foreign Application Priority Data

Apr. 28, 1976 [IT] Italy ..... 9005 A/76
May 14, 1976 [IT] Italy ..... 9008 A/76

[51] Int. Cl.[2] ..... E02B 7/40
[52] U.S. Cl. ..... 61/27; 61/25
[58] Field of Search ..... 61/25, 22, 23, 26, 27, 61/29, 30

[56] References Cited

U.S. PATENT DOCUMENTS

| | | | |
|---|---|---|---|
| 194,922 | 9/1877 | Marshall | 61/25 |
| 1,179,520 | 4/1916 | Grunsky | 61/27 |
| 3,756,032 | 9/1973 | Solinas | 61/25 |

FOREIGN PATENT DOCUMENTS

| | | | |
|---|---|---|---|
| 747,149 | 3/1956 | United Kingdom | 61/25 |

*Primary Examiner*—Jacob Shapiro
*Attorney, Agent, or Firm*—Stevens, Davis, Miller & Mosher

[57] ABSTRACT

Manoeuvrable weir comprising at least one flap hinged to a threshold shelter laid on the bottom of a waterway to be dammed. The flap foresees openings on its surface from which lead out conduits which debouch in correspondence of the threshold structure, creating over it a water current.

5 Claims, 4 Drawing Figures

FIG. 3
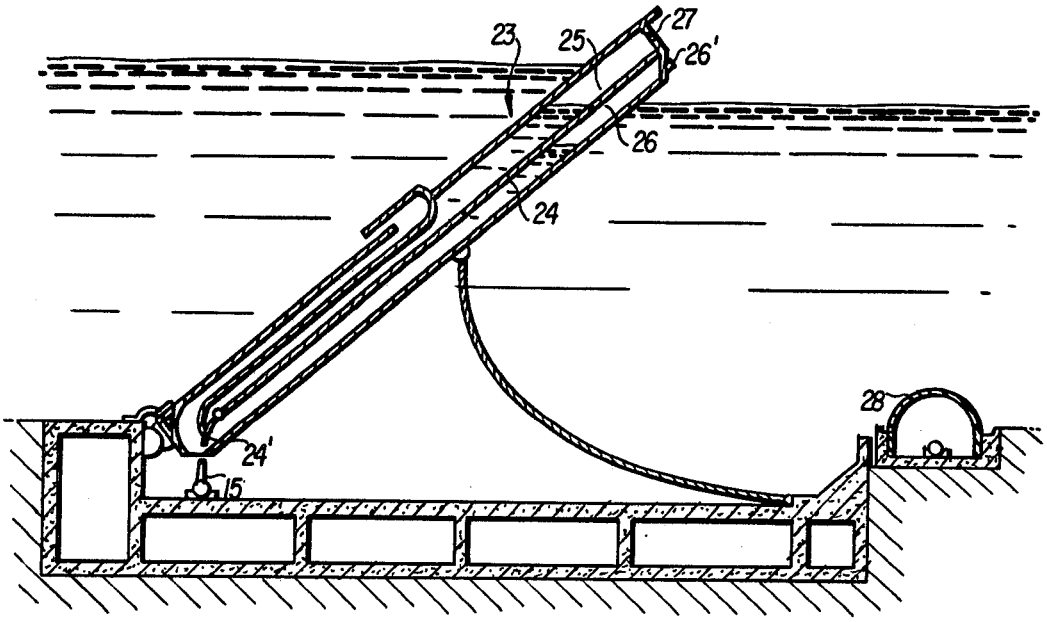
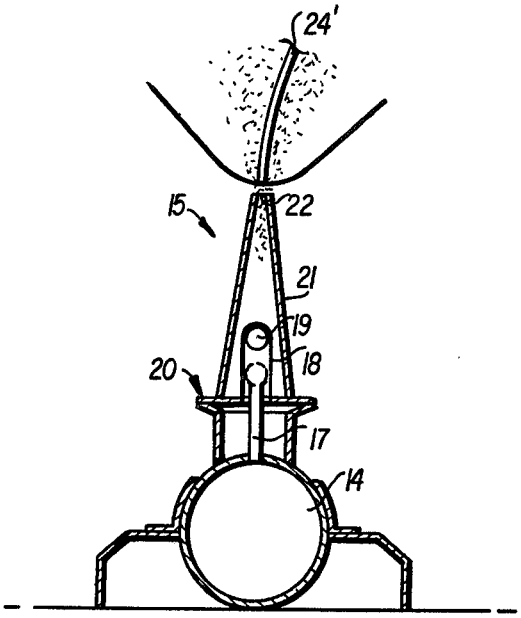
FIG. 4

MANOEUVRABLE WEIR

The present invention concerns a manoeuvrable weir. In particular, the present invention refers to a manoeuvrable weir of the type composed by at least one metallic flap hinged to a threshold shelter anchored to the bottom of the waterway to be dammed, provided with tanks into which air and/or water can be admitted or extracted by means of conduits, for operating the metallic flap itself.

Manoeuvrable weirs of the type briefly described above, are well known.

Known weirs, of the type in question, have the disadvantages of showing a lack of reliability, and their cost is considerably high owing to two peculiar characteristics namely:

(a) the presence of organs of interception on the conduits for water and for air which also complicates the distribution net-work for the said fluids, and (b) the presence of costly devices for preventing the burying in the sand of the threshold shelter.

Another drawback of the known weirs is the difficulty they have in controlling in a sure way, the position of the flap, either during the manoeuvre, or when under service conditions - especially when the weir should be achieved by placing several flaps side by side to each other.

As a matter of fact, an increased weight, for example, due to encrustments or to it being buried in the sand, or to hydraulic currents occuring in the waterway where the flap is positioned, or to small variations in the level, may determine notable difference in the inclination; when the flaps are mounted, side by side, considerable losses of water are caused between the adjoining basins at different levels and this fact prejudices an effective damming of the weir itself.

Besides this fact, should the manoeuvrable weir have to face varying operating conditions, with differences in levels even being inverted between the basins created by the weir itself and especially when the values of the differences in level of said basins can vary - as is generally the case whenever one of the adjoining basins created by the weir, happens to be the sea, it is discovered that the asset of having a flap is notably mutatable depending on the conditions involved, with a probability of creating truly difficult equilibrium conditions.

The present invention aims at a manoeuvrable weir where the flap equilibrium, when under service conditions, is ensured in a way that is absolutely reliable, and where the risks are aliminated as to the threshold shelter being buried in the sand.

The object of the present invention concerns a manoeuvrable weir comprising at least one metallic flap, provided with an air-tank, hinged to a threshold shelter disposed at the bottom of the waterway to be dammed, characterized by the fact that it contains openings in the metallic flap from which openings conduits depart, leading forth with an elbowed curve, in correspondence of the threshold shelter, and means for admitting air into the air-tank of the metallic flap, said air-tank being an upturned glass type of air-tank equipped with relief valves in correspondence of its summit top. The present invention will be better understood from the following detailed description referring, by way of non limiting example, to the figures in the accompanying drawing sheets, where:

FIG. 3 shows a cross-sectional view of the weir, according to the invention, in an alternative embodiment;

Figure 1:
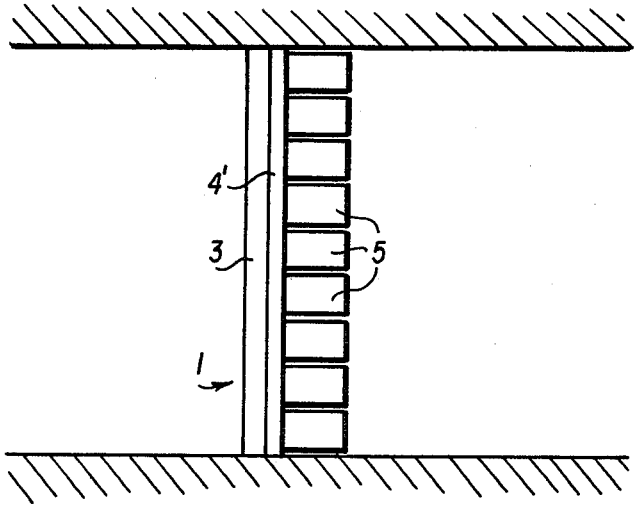
FIG. 1 shows a plan view of a manoeuvrable weir according to the present invention.
Figure 2:
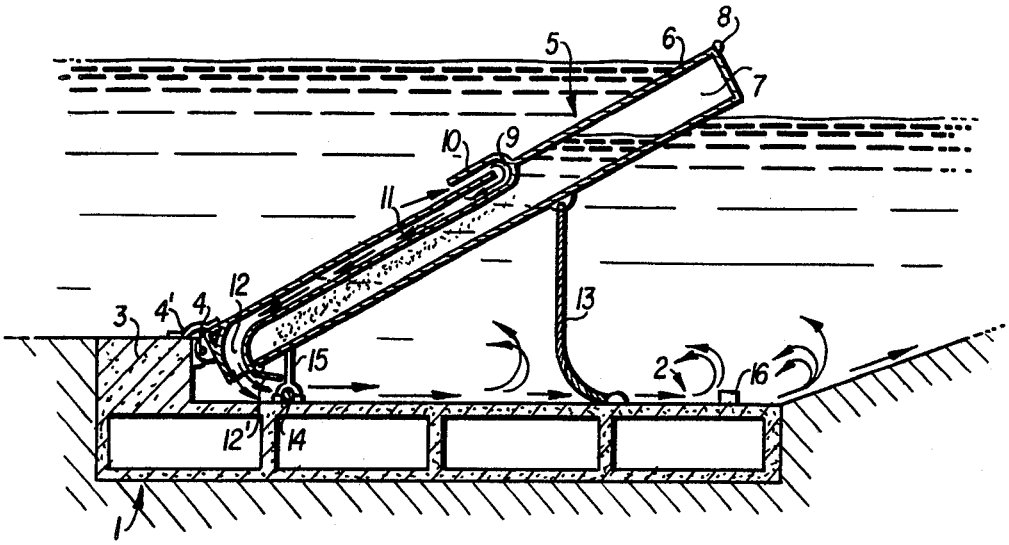
FIG. 2 shows a large-scale view of the cross-section of a manoeuvrable weir according to the invention, taken along the line II—II of FIG. 1.

FIG. 4 shows a large scale detail of the weir according to the invention. As can be seen in FIGS. 1 and 2 the manoeuvrable weir, according to the present invention, comprises a threshold shelter 1 in reinforced concrete in which is foreseen a hollow recess 2.

In the threshold shelter 1, in correspondence of the edge 3, there is sealingly hinged at 4, by means of a hinge clad with a fabric tape 4' , at least one metallic flap 5 of suitable length, and in particular a plurality of metallic flaps 5 — as is visible in FIG. 1.

The metallic flap 5 is composed of a plate 6 of metallic material to which is fixed an upturned-glass type of air-tank 7 also in metallic material, equipped with an opening or relief valve 8.

On the face of plate 6 in metallic material there are foreseen a plurality of holes 9 protected by panels 10.

From holes 9 there depart a plurality of conduits 11 provided with an elbowed curve 12 localized in correspondence of the zone in the metallic plate 6, where the latter is hinged to the threshold shelter.

In correspondence of the exit opening of the elbowed curve 12 there is present a fin of flexible material such as rubber for example, acting as a non-return valve.

The metallic flap 5 is, besides this, connected to the threshold shelter 1 by means of flexible tie-rods 13 such as for example a rope or a chain.

Besides this, in the threshold shelter 1, in the vicinity of the zone where the metallic flap 5 is hinged, there is foreseen a conduit 14 of pressurized air, from which depart a plurality of nozzles 15 which shall be described later on.

Eventually, still yet in the threshold shelter 1 and more particularly within its recess 2 there are foreseen a plurality of blocks 16 as for example out of elastomeric material for supporting the metallic flap 5 when the latter is housed in the recess 2 of the threshold shelter.

In FIG. 4, a nozzle is represented in large scale, as departing from conduit 14 for pressurized air.

As can be seen in FIG. 4, the nozzle 15 comprises a small tube 17 debouching into a cage 18 in which is lodged a metallic ball. The small tube 17 and the cage 18 are covered by a capsule 20, fixed to the threshold shelter 1, which has its portions 21 of a tronco-conical shape with an opening 22 in correspondence of the lesser base.

In FIG. 3 there is represented a manoeuvrable weir, according to the present invention, in an alternative embodiment to the one represented in FIG. 2.

As can be seen in FIG. 3, the metallic flap 23, presents on its inner side a plate 24 which originates by its presence, two spaces 25 and 26. The space 25 presents in correspondence of its extremity 27, a wide-mouthed opening 28; whereas the space 26 is a closed space, that forms the true upturned-glass type of air-tank equipped with an air-valve 26'. In particular the plate 24, in corrispondence of the part of the metallic flap 23 facing the nozzles 15, presents a orientatable fin 24'.

Besides this, in correspondence of the extremity of the threshold shelter on the opposite side to where the metallic flap 23 is hinged, there is present an inflatable and deflatable chamber 28 surrounding the entire border of the threshold shelter, in order to ensure a better guarantee for the threshold shelter against any risk of being buried in the sand. As for the other parts, the manoeuvrable weir according to the embodiment represented in FIG. 3 are the same as those of the embodiment represented in FIG. 2.

The operation of the manoeuvrable weir in the form of the embodiment represented in FIG. 2 is as follows:

Starting with the collapsed state of the flap 5, that is when it is housed in the recess 2 of the threshold shelter 1 — by means of the nozzles 15, air is admitted into the flap itself and more precisely inside the upturned-glass type of air-tank 7 of the flap 5. The air, bubbling inside the air-tank, fills it, and gives buoyancy to the said flap 5 which, rotating around the hinge 4, arises till it creates differences in the levels between the basins above and below the weir — as represented in FIG. 2.

The air is admitted continuously into the upturned-glass type of air-tank of the metallic flap, for the whole time when the flap is raised from the bottom i.e. it is in its working position because said air is continuously being outletted through the holes or relief-valves 8 existing in the flap itself. Besides this, the regulating of the flap position is effectuated by means of varying the quantity of air supplied through the nozzles 15.

By creating the differences in the levels of the basins above and below the weir, according to the invention, a situation is created by which the water from the higher level basin flows down into the lower level basin passing through the holes 9 present in plate 6, and flowing via the conduits 11 to enter into the recess 2 of the threshold shelter 1 of the weir. In this way there is created in said threshold shelter, a fluid current that keeps clean said recess from sand and the like.

In order to collapse the flap, it is enough to cease admitting the air into the conduits 14 and hence into nozzles 15; by this way the air present in the air-tank 7, in slowly issuing out from the holes and valve 8 diminishes the inherent buoyances of the flap which gradually continues to rotate around hinge 4, and slows down to a halt against the threshold shelter 1, thence to be housed in the recess 2 of the latter.

Regarding the operation of the manoeuvrable weir according to the form of embodiment represented in FIG. 3, this operation is substantially identical to that of the manoeuvrable weir of FIG. 1.

The only differences in the operations refer to the capacity of the flap to maintain a pre-established position as a function of the positions which the fins 24' are made to assume. As a matter of fact, by assuming as equilibrium position i.e. the positions represented in FIG. 3, in case of variations to the external conditions of the weir, compelling the flaps to form with the threshold shelter a greater angle, the rotations of the flap around the hinge cause the air supplied by the nozzles to be admitted into the space 25, from where said air is rapidly expelled out. At the same time the air, contained inside the space 26 which forms the true upturned-glass type of air tank, gradually issues out through the valve 26, said space 26 not being fed with air by the nozzle.

This determines the collapsing of the flap, and thus reinstates the pre-established equilibrium angle for said flap.

From the description of the embodiments of a manoeuvrable weir according to the present invention, it can easily be understood that the above stated aims are reached.

As a matter of fact the operation of a weir according to the present invention, is an entirely reliable, i.e. it is secure in operation, as it can be noted that, thanks to its form of construction which makes the flap resemble a box having part of its bottom missing, said flap, when in its at rest position, forms a formidable bell-shaped tank which is possible to refill completely with air for obtaining a rising push which is equal to the volume of the entire flap; this constitutes a substantial guarantee against any eventual sediments or deposits of solid material settling over the flap itself during its inactive period Besides this, the presence of means capable with the aid of a water current to clean the threshold shelter, and above all the sheltered recess for the flap when the latter is raised, renders secure the chances of completely collapsing the flap and hence provides a guarantee for the weir according to the invention to function.

Finally the presence of means which allows the flap to maintain a pre-established position, even when facing disturbing actions such as bumps or the like, renders completely secure the functioning of the weir according to the invention.

Although particular embodiments of the invention has been illustrated and described here, it is understood that the invention includes in its scope any other alternative embodiment accessible to a technician of this field.

What is claimed is:

1. A weir for damming water in a waterway comprising a base member disposed on the bottom of the waterway and a pivotable flap member having a wall enclosing an elongated space adapted to contain air under pressure, said flap member having one end wall hinged to the base member and an opposite end wall disposed above the base member and having one sidewall which faces the base member and an opposite sidewall, said flap member being inclined upwardly from its hinged end above the base member, means in said wall adjacent to said opposite end for relieving pressure in said elongated space, a plurality of spaced first openings in said opposite side of the said wall member, conduit means disposed in said elongated space adjacent said opposite sidewall and connected to each of said first openings, means external of the said opposite wall protecting each of said first openings, an elbow curved portion in the wall of each conduit adjacent said hinged end of the flap member and having a second open end to permit water flowing through the said first openings and conduit to flow out into the waterway below the flap member, means for checking flow of water into the conduit through said second opening, and means for admitting air under pressure into the said elongated space.

2. The weir of claim 1 comprising a plate disposed inside the said elongated space which divides it into two parts, said plate having an orientable fin disposed in the vicinity of the means for admitting air into the elongated space, one part of said air tank having a wide mouth opening facing outwardly and the other part having a valve for the outflow of air.

3. The weir of claim 1 having a flexible fin over said second openings which forms a non-return valve in the opening.

4. The weir of claim 1 wherein said means for admitting air to the elongated space comprises a plurality of nozzels provided with non-return valves.

5. The weir of claim 1 comprising a flexible rope-like member fastened at one end to said flap and at the other end to said base member.

* * * * *